US006897806B2

(12) United States Patent
Toshev

(10) Patent No.: US 6,897,806 B2
(45) Date of Patent: May 24, 2005

(54) METHOD AND DEVICE FOR SCANNING A PHASED ARRAY ANTENNA

(75) Inventor: Aleksander Toshev, Sofia (BG)

(73) Assignee: Raysat Cyprus Limited, Nicosia (CY)

( * ) Notice: Subject to any disclaimer, the term of this patent is extended or adjusted under 35 U.S.C. 154(b) by 0 days.

(21) Appl. No.: 10/480,622

(22) PCT Filed: Jun. 13, 2002

(86) PCT No.: PCT/BG02/00008

§ 371 (c)(1),
(2), (4) Date: Dec. 12, 2003

(87) PCT Pub. No.: WO02/103842

PCT Pub. Date: Dec. 27, 2002

(65) Prior Publication Data

US 2004/0233103 A1 Nov. 25, 2004

(30) Foreign Application Priority Data

Jun. 14, 2001 (BG) ..... 105597

(51) Int. Cl.[7] ..... H01Q 3/26
(52) U.S. Cl. ..... 342/374; 342/383; 342/373
(58) Field of Search ..... 342/383, 372–374

(56) References Cited

U.S. PATENT DOCUMENTS

| | | | | |
|---|---|---|---|---|
| 3,816,830 A | | 6/1974 | Giannini | |
| 4,041,501 A | | 8/1977 | Frazita | |
| 4,123,759 A | * | 10/1978 | Hines et al. | 342/374 |
| 4,612,547 A | | 9/1986 | Itoh | |
| 5,079,557 A | * | 1/1992 | Hopwood et al. | 342/372 |
| 5,854,610 A | * | 12/1998 | Wojtowicz et al. | 342/372 |
| 6,016,123 A | * | 1/2000 | Barton et al. | 342/373 |
| 6,184,828 B1 | * | 2/2001 | Shoki | 342/372 |
| 6,504,505 B1 | * | 1/2003 | Yung | 342/374 |
| 6,661,375 B2 | * | 12/2003 | Rickett et al. | 342/383 |
| 2002/0080066 A1 | * | 6/2002 | Dent | 342/373 |
| 2002/0167445 A1 | * | 11/2002 | Eden | 342/383 |

OTHER PUBLICATIONS

P.S. Hall et al., Review of radio frequency beamforming techniques for scanned and multiple beam antennas, Microwaves, Antennas and Propagation, IEE Proceedings H, vol. 137(5), p. 293–303 , Oct. 1990.*

* cited by examiner

*Primary Examiner*—Thomas H. Tarcza
*Assistant Examiner*—F H Mull
(74) *Attorney, Agent, or Firm*—Nexsen Pruet Adams Kleemeier, LLC; Michal A. Mann

(57) ABSTRACT

A method for scanning of antenna array, wherein on output signals from radiating elements are applied phases offset in order to obtain signals with approximately equal phases. The obtained signals are subsequently summated. The method is characterized in that before application of phase control the output signals from radiating elements are grouped by means of summation of the signals with approximately equal phases in order to form equivalent group signal. Subsequently the phase offset is applied on all group signals and subsequently all group signals are summated. A phase control device for the application of the method comprises, phase shifting elements grouped in a phase control block, a controlling block, and a block of switches connected between inputs from the antenna radiating elements and the phase control block, wherein the outputs of the controlling block are connected to control inputs of the block of switches, and the phase control block includes internal summators (3) whose inputs are connected to the block of switches (2) and outputs are connected to a common summation circuit (4) via corresponding phase shifting element (5).

10 Claims, 5 Drawing Sheets

METHOD AND DEVICE FOR SCANNING A PHASED ARRAY ANTENNA

TECHNICAL FIELD

The present invention relates to a method for scanning of phased array antennas in general and a phase control device for application of the method, both used in telecommunication systems.

PRIOR ART

In international publication WO98/05089 a phase control device is presented, containing phase shifting elements, electrically connected to a set of switches electrically interconnected to each other and separated from the phase shifting elements. The phase control device is intended for application in phased array antennas, containing plurality of transmit/receive modules. Application of this phase control device presumes connection of a transmit/receive module to one input of the device. The phase shifting elements can be connected in serial or in parallel, the set of phase shifting elements and the set of switches can be sectioned in phase control units, which can be connected in serial, in parallel, or part in serial and part in parallel.

A disadvantage of the phase control device is the relatively large number of the phase shifting elements, which leads to complicated architecture of the phased array antenna.

SUMMARY OF THE INVENTION

The main goal of the present invention is to propose a new method for scanning of a phased array antenna and a phase control device for realization of the method, which allow reduction of the number of phase shifting elements and subsequent simplification of the architecture of the phased array antenna with negligible deterioration of its technical characteristics and main parameters.

The goal is achieved with a method for scanning of a phased array antenna, in which phase offset is applied on output signals from the radiating elements so that signals with almost equal phases are obtained and after that all signals are summed. An important feature of the method is that before application of the phase control output signals from the radiating elements are grouped by means of summation of the signals with approximately equal phases so that equivalent group signal is obtained. Phase offset is applied on the group signal from each group and after that all group signals are summed.

In one preferred version of the method output signals from the radiating elements form two orthogonal components of the electromagnetic field, each one grouped in a separate group for the corresponding component, the two group signals are then amplified and the phase control is applied on each one of the signals separately.

It is preferable if the two orthogonal components are for vertical polarized and horizontal polarized component of the electromagnetic field.

It is expedient if grouping is performed in a way that one group assembles signals with phase offsets in the range 0° to 180° range and the other group—signals with phase offsets in the range 180° to 360°.

The goal is achieved also with a phase control device, containing phase shifting circuits grouped in a phase control block, controlling block, block of switches connected between inputs from the antenna radiating elements and the phase control block, wherein outputs of the controlling block are connected to control inputs of the block of switches. An inherent feature of the device is that phase control block contains internal summators, whose inputs are connected to the block of switches and outputs are connected to a common summation circuit through corresponding phase shifting element.

In one preferred version of the phase control device groups of radiating elements are connected to its inputs.

In one version of the phase control device its inputs for the signals from the radiating elements are separated for the two orthogonal components of the signal.

It is expedient if the outputs of the radiating elements are connected to the inputs of the phase control device trough amplifiers of the signal.

An advantage of the method for scanning of the phased array antenna and the phase control device for the realization of the method is the significant reduction of the number of phase control devices due to dynamic grouping of the signals. The reduced number of phase shifting elements allows simplification of the architecture of the phased array antenna and at the same time increase of the number of antenna elements, controlled by one phase control device.

EXAMPLES FOR REALIZATION OF THE INVENTION

Figure 1:
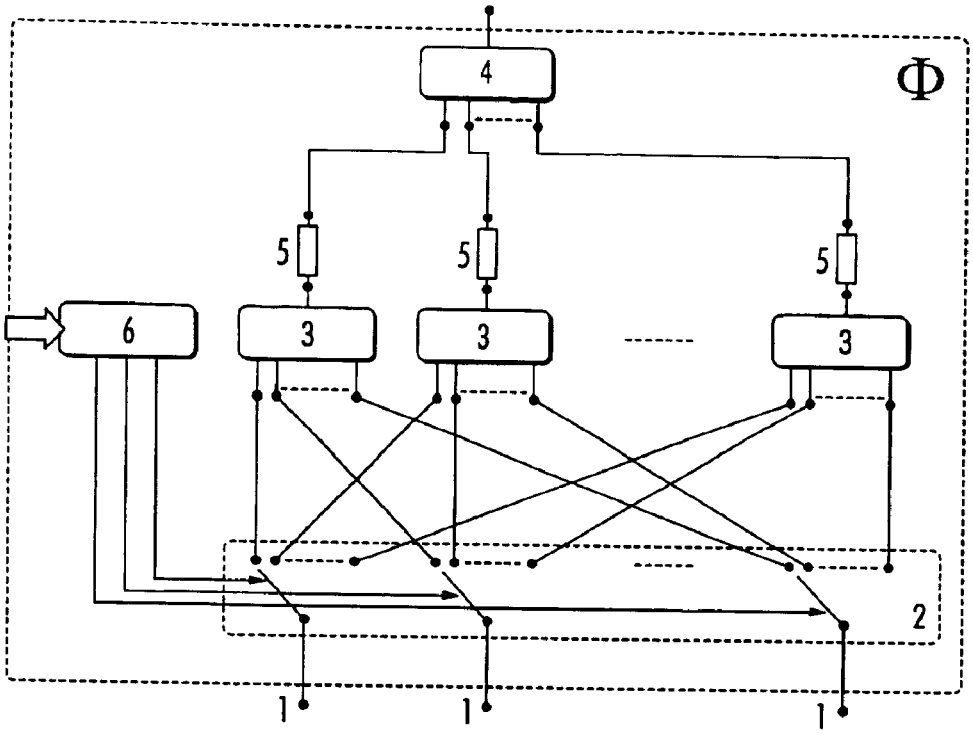
FIG. 1 represents a block diagram of the basic version of the phase control device according to the invention
Figure 2:
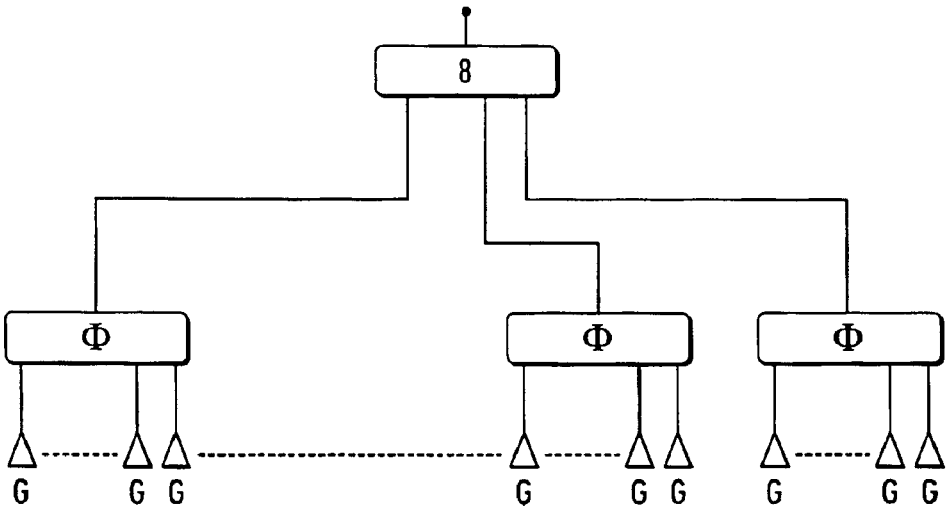
FIG. 2 represents a principal diagram of the phased array antenna
Figure 3:
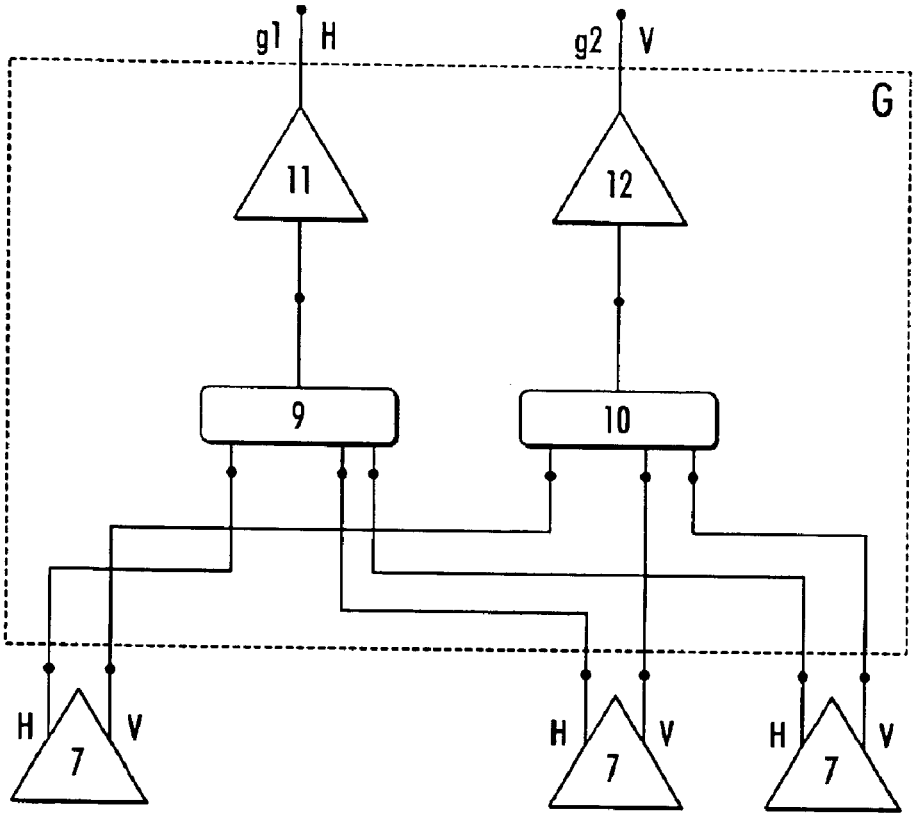
FIG. 3 represents one group of radiating elements with outputs for the horizontal and the vertical component of the signal

The phase control device according to the invention (FIG. 1) has several inputs 1, to which the outputs of the groups G of antenna radiating elements 7 are connected (shown on FIGS. 2 and 3). Inputs 1 are connected to the block of switches 2, whose outputs are connected to internal summators 3. Group signal is obtained at the outputs of each of summators 3 as a result of the control of the state of switches in the block of switches 2. In this way dynamic grouping of the signals is obtained. The output of each summator 3 is connected to a corresponding input of common summation circuit 4 trough phase shifting elements 5. Output of the circuit 4 is the output of the phase control device. Outputs of the block for control of the phase 6 are connected to the control inputs of the block of switches 2. The phase control device on FIG. 1 is denoted with the letter "ϕ".

A principal diagram of a phased array antenna (FIG. 2) includes several phase control devices $\phi_1, \phi_2 \ldots \phi_n$, like the one described above, to which inputs are connected the outputs of the groups G of radiating elements 7. The outputs of the phase control devices are connected to the inputs of summation circuit 8 of the phased array antenna.

A way of grouping of antenna radiating elements 7 of the phased array is shown on FIG. 3. The figure illustrates group G of twelve radiating elements 7. This is a static grouping since it is not changed in the process of operation of the antenna. Each radiating element 7 has an output V for the vertical component and an output H for the horizontal component of the electromagnetic field. Summation circuit 9 sums outputs H, while summation circuit 10—outputs V. Group signals for the horizontal and the vertical component of the electromagnetic field obtained at the outputs of summation circuits 9 and 10 are amplified by amplifiers 11 and 12. Obtained signals are phase controlled by the corresponding phase control device for the given group radiating elements 6. The diagram of grouping of the radiating elements from FIG. 3 is denoted as "G".

Figure 4:
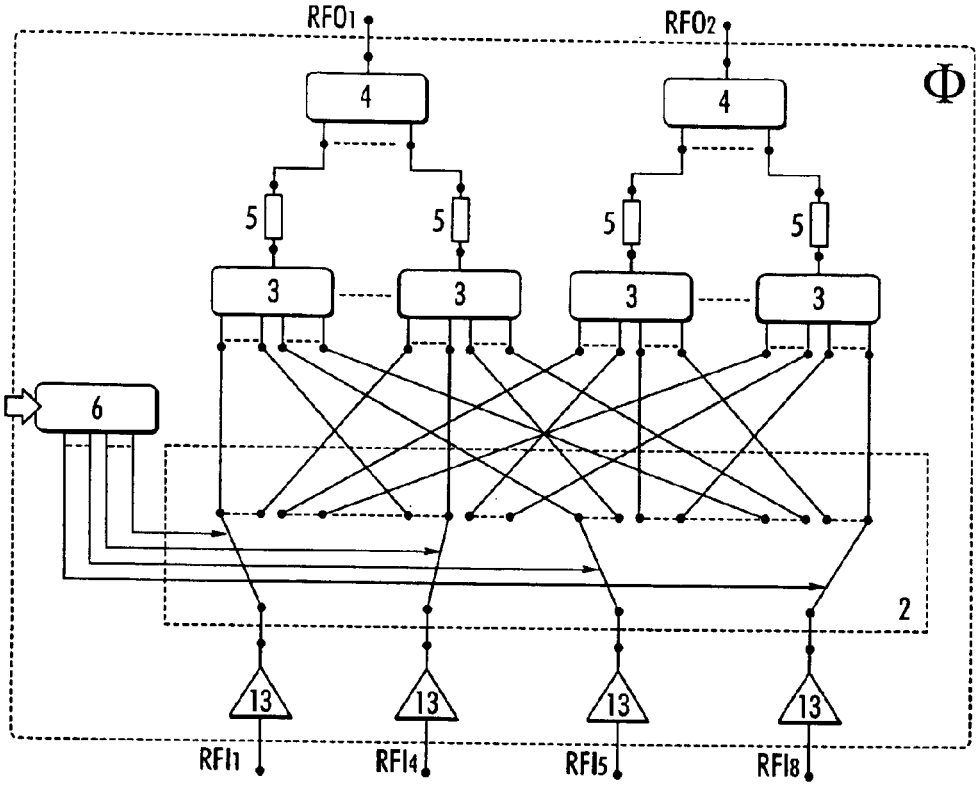
FIG. 4 represents one version for realization of the phase control device according to the invention

The phase control device shown on FIG. 4 is similar to that shown on FIG. 1. The phase control device shown on FIG. 4 has eight high frequency inputs 1 $RFI_1 \ldots RFI_8$, two high frequency outputs $RFO_1$ and $RFO_2$, a block of switches 2 and eight internal summators 3 with eight inputs each. The outputs of the first four summators 3 are connected to the first summation circuit 4 trough the first set of phase shifting elements 5, while the outputs of the second four summators 3 are connected to the second summation circuit 4 trough the second set of phase shifting elements 5. The two sets of phase shifting elements 5 may be with identical values, but that is not obligatory. The outputs of the controlling block 6 are connected to the control inputs of the block of switches 2.

Figure 5:
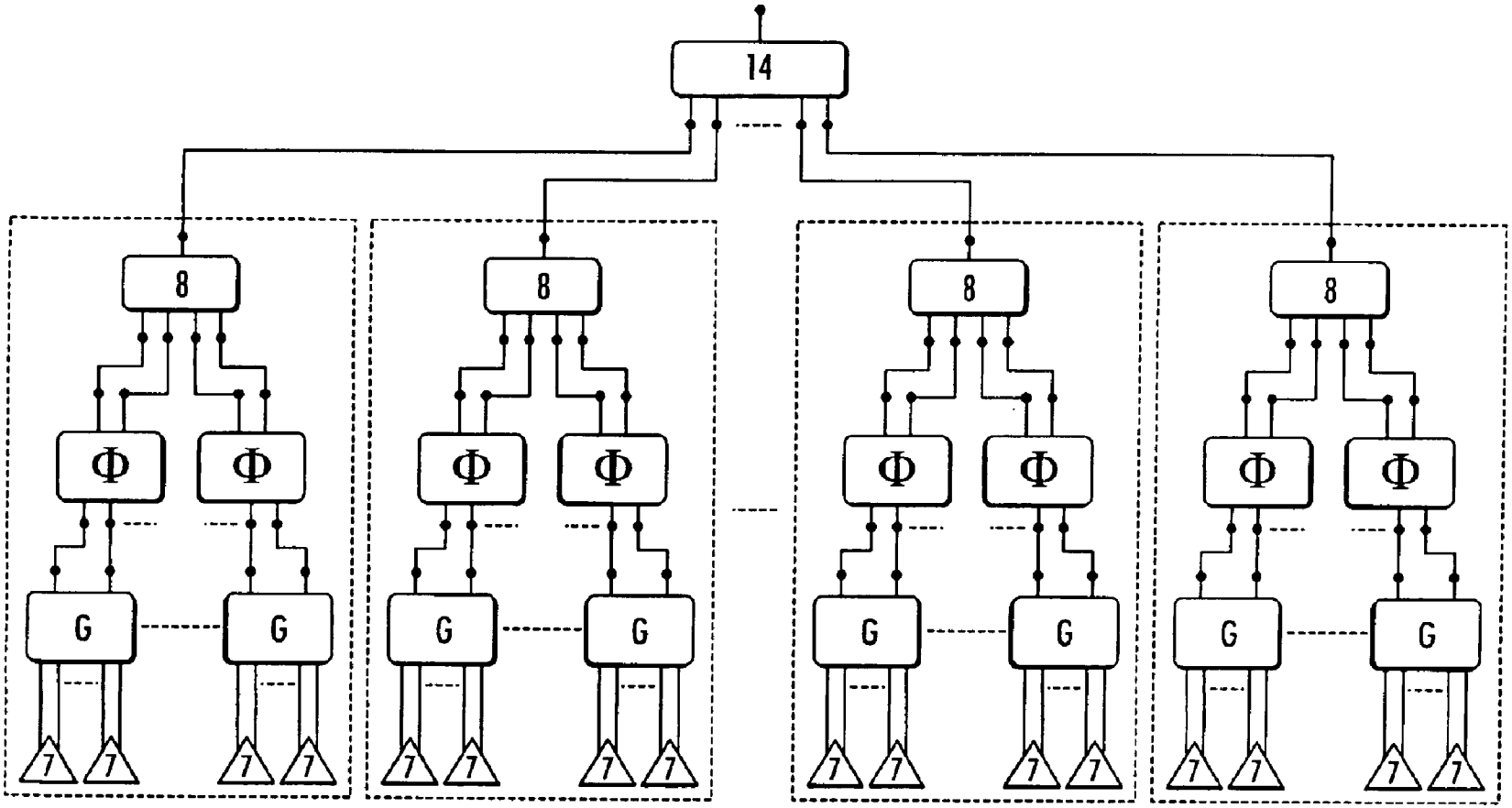
FIG. 5 represents a block diagram of a phased array antenna with a set of phase control devices, like the one shown on FIG. 4

The block diagram of the phased array, shown on FIG. 5, depicts the overall architecture of the phased array antenna, realized with phase control devices $\phi$ according to the present invention. Output signal of the phased array is obtained at the output of summation circuit 14, to which outputs are connected the outputs of each of the phase control devices $\phi$.

The operation of the phase control device according to the present invention is:

Signals from the groups G of radiating elements 7 are applied to the inputs of the phase control device $\phi$ (FIG. 1). Upon command from the controlling block 6 the state of each one of the switches from the block of switches is set 2. In this way signals with approximately equal phases are grouped. Group signals at the outputs of each one of the summators 3 are phase shifted trough a corresponding phase shifting element 5 and in this way all the group signals are led to the same phase state so that the summation circuit 4 can sum them. The same operations are performed for each one of the groups of radiating elements connected to the particular phase control device (FIG. 5). Output signals formed in this way are in principal of equal phase states and are summed by the summation circuit 14, which forms the output signal of the phased array antenna.

The operation of the group of radiating elements G is as follows: Each one of the radiating elements 7 has two outputs for the vertical and the horizontal component of the electromagnetic field. Signals from all outputs for the vertical component of the electromagnetic field are summed by the summation circuit 9, thus forming a common signal for the group of twelve radiating elements 7 for the vertical component of the electromagnetic field. In the same way signals from all outputs for the horizontal component of the electromagnetic field are summed by the summation circuit 10, thus forming a common signal for the group of twelve radiating elements representative for the horizontal component of the electromagnetic field. The two components are then amplified by the amplifiers 11 and 12, which form the two outputs of the group G of radiating elements for the vertical V and the horizontal H component of the electromagnetic field accordingly. Phase control is applied on these two signals and scanning of the main beam of the phased array is obtained by applying phase control on the two outputs of the group of radiating elements as a whole. Polarization control of the antenna is obtained by proper selection of the phase relations between the horizontal and the vertical component of the electromagnetic field of the group of radiating elements. It is seen that scanning of the main beam of the antenna and its polarization control is obtained by applying phase control on the two outputs of the group G of radiating elements 7. In this particular case the horizontal and the vertical component of the electromagnetic field are considered, but the same principal could be applied to every two orthogonal components of the electromagnetic field.

A necessary and sufficient condition for adequate operation of the antenna is the selection of two orthogonal components of the electromagnetic field, which are formed at the output of the radiating elements 7 and at the output of the group of radiating elements G. The two orthogonal output components at the output of the radiating elements 7 and at the output of the group of radiating elements G must not necessarily coincide. It is possible to perform transformation of the polarizations inside the summation circuits 9 and 10. The main goal of the group of radiating elements G is to reduce the number of the signals on which phase control is applied and in this way to reduce further the number of the phase control devices needed for realization of the antenna.

The phase control device presented on FIG. 4 operates in the following way:

Input signals with random phases uniformly distributed in the range 0° to 360° are amplified by the amplifiers 13 and are fed at the inputs of the block of switches 2. Upon adequate key combination of the switches of this block, determined by the controlling block (for example adequate key word), the input signals, which are with close phases in the range 0° to 180° are guided to the first group of summators 3 and correspondingly to the first set of phase shifting elements 5, while the input signals with close phases in the range 180° to 360° are guided to the second group of summators 3 and correspondingly to the second set of phase shifting elements 5. Thus the input signals are divided in two groups so that the phase difference between each two signals in each group is not bigger than 180°. The key combination of the switches in the block 2 are selected in a way that signals with a phase difference not greater than 45° are summed by the summators 3 before phase shifting elements 5. Thus the output signals from phase shifting elements 5 from each one of the two groups are with approximately equal phases and the phase difference between the two groups of signals is approximately 180°. The signals from each one of the two groups are summed by the two summators 4 and the two summation signals at the output of the summators 4 form the two high frequency outputs RFO1 and RFO2 of the phase control device $\phi$. The phase difference of the two output signals is approximately 180°. By applying an additional 180° phasing section the two output signals of the phase control device $\phi$ can be lead to the state of approximately equal phases and can be summed. The main role of the phase control device is to apply phase control on signals obtained from the radiating elements 7. In the realization presented here phase control is applied on the group signal from the group of radiating elements 7, but the same control can be applied on the signal from the single radiating element.

Summation circuits for the high frequency band contain set of microwave power summators.

The main goal of these circuits is to sum the signals at the outputs of the phase control devices and to provide an additional 180° phase shift for selected signals.

The circuit shown on FIG. 5 operates in the following way:

At the input of the radiating elements 7 there comes a signal with different phases, depending on the position of the radiating element 7 on the antenna aperture. The input signal contains information for two orthogonal components of the electromagnetic field. Separated signals for the two orthogonal components of the electromagnetic field are obtained at the output of the radiating elements 7 (in this particular case V and H). The components of the electromagnetic field, which are of the same type, are grouped in groups of twelve radiating elements, summed by the internal summators 9, 10 (see FIG. 3) and are then amplified by the amplifiers 11, 12 of the group of radiating elements. In this way two signals are obtained, which contain information about the average value of the two orthogonal components from the corresponding twelve radiating elements. The signals at the output of the group of radiating elements are with different phases, depending on the antenna polarization and on the position of the radiating elements 7 on the aperture of the antenna. A further goal is to apply an additional phase shift on the signals coming from the groups of radiating elements so that (differences) in their phases are compensated and signals with equal phases are obtained. Signals from the groups of radiating elements G come at the input of the phase control devices ϕ. By means of an internal for the phase control devices block of switches 2 and summators 3 signals at their inputs with phases in the range 0°–360° are divided in two groups of signals with phases in the ranges 0°–180° and 180°–360° respectively. Signals, taking part in a particular group, are phase equalized by means of internal for the phase control devices phase shifting elements 5 and are then summed. The summation signal is amplified and comes to one of the outputs of the phase control device depending on whether the phases of the signals before summation were in the range 0°–180° or 180°–360°. At the first outputs of the phase control devices (according to their principal of operation) signals with phases approximately equal to 0° are obtained, while at the second output signals with phases approximately equal to 180° are obtained. Further additional phase shift is applied in the power summators 8 for the signals from the second outputs of the phase control devices so that they are phase equalized with the signals from the first outputs and all the signals are then summed by the common summation circuit 14.

By means of non-equal power summation in the common summation circuit 14 it is possible to apply non-equal amplitude distribution between different parts of the antenna aperture. This effect could be achieved by means of summation of the energy from the different parts using various weighting coefficients for the different parts of the antenna.

The phase control device according to the invention, when used in the way described above, is capable of moving the antenna beam in the limited spatial angle, determined by the size of the group of radiating elements, as well as of controlling the polarization of the antenna with respect to the selected phase shifting elements 5 inside the phase control devices ϕ.

The examples described above are just illustrative. There are different variants and modifications of the method which are obvious for the skilled in the art and could be developed without getting out of the scope of protection, as described in the patent claims.

What is claimed is:

1. A method for scanning of antenna array including the steps of:

obtaining output signals from radiating elements of an antenna array;

dynamically grouping the obtained signals by means of summation of signals of approximately equal phases in order to form equivalent group signals;

applying predetermined phase offsets to said equivalent group signals; and subsequently summing of all group signals after the application of the predetermined phase offsets.

2. A method according to claim 1, characterized in that where output signals from the radiating elements form two orthogonal components of the electromagnetic field, each component is grouped forming equivalent group signal for the corresponding component, after that the two equivalent group signals are amplified and the phase control is applied to each of the signals separately.

3. A method according to claim 2, wherein the two orthogonal signals correspond to horizontal and vertical components of the electromagnetic field.

4. A method according to claim 1, wherein one group contains signals with phases in the range 0° to 180° and the other group contains signals with phases in the range 180° to 360°.

5. A phase control device comprising:

plural phase shifting elements (5) grouped in a phase control block (ϕ), said plural phase shifting elements (5) having plural inputs, said phase control block (ϕ) having an output;

a controlling block (6) having an output;

a block of switches (2) that is connected to said output of said controlling block (6) and is located between inputs of radiating elements (7) and said output of said phase control block (ϕ), the phase control block (ϕ) including internal summators (3) having inputs connected to said block of switches (2) and outputs connected to said plural inputs of said plural phase shifting elements (5), said internal summators (3) forming grouped signals of said signals from said block of switches (2) with approximately equal phases and sending said grouped signals to said plural phase shifting elements (5); and a common summation circuit (4) having plural inputs, wherein said outputs of said phase shifting elements (ϕ) are connected to said inputs of a common summation circuit (4) for summation by said common summation circuit (4).

6. A phase control device according to claim 5, wherein inputs (1) are connected to groups (G) of radiating elements (7).

7. A phase control device according to any one of claim 5, or 6, wherein the inputs (1) for signals from the radiating elements (7) are separated for two orthogonal components of the signals.

8. A phase control device according to claim 6, wherein the outputs of the radiating elements (7) are connected to inputs (1) of the phase control device through amplifiers of the signal (13).

9. A phase control device according to claim 7, wherein the outputs of the radiating elements (7) are connected to inputs (1) of the phase control device through amplifiers of the signal (13).

10. A phase control device according to claim 5, wherein the outputs of the radiating elements (7) are connected to inputs (1) of the phase control device through amplifiers of the signal (13).

* * * * *